US005692698A

United States Patent [19]

Forbes

[11] Patent Number: 5,692,698

[45] Date of Patent: Dec. 2, 1997

[54] WEB FEEDING AND TRANSITION ASSEMBLY

[76] Inventor: Thomas J. Forbes, R.D. 4, Box 211-A, Towanda, Pa. 18848

[21] Appl. No.: 595,437

[22] Filed: Feb. 5, 1996

[51] Int. Cl.[6] ..... B65H 19/18

[52] U.S. Cl. ..... 242/533.4; 242/552; 242/555; 242/559.2

[58] Field of Search ..... 242/533.4, 533.5, 242/533.6, 559.2, 594.3, 494.4, 552, 555, 555.1, 555.2, 538

[56] References Cited

U.S. PATENT DOCUMENTS

| | | | |
|---|---|---|---|
| 1,567,449 | 12/1925 | Monk | 242/594.3 |
| 2,655,321 | 10/1953 | Sternad et al. | 242/559.2 |
| 2,658,691 | 11/1953 | Mallory | 242/559.2 |
| 2,668,572 | 2/1954 | Bostwick | 242/559.2 |
| 3,627,616 | 12/1971 | Davis | 242/552 |
| 4,233,104 | 11/1980 | Fujishima et al. | 242/555 |
| 4,555,281 | 11/1985 | Mattei et al. | 242/552 |
| 5,487,805 | 1/1996 | Boriani et al. | 242/552 |

*Primary Examiner*—John M. Jillions
*Attorney, Agent, or Firm*—Salzman & Levy

[57] ABSTRACT

The present invention features a web feeding and transition assembly for exchanging a first, used, web roll for a second, fresh, web roll, so that web material will be continuously conveyed along a web-conveying feed path. Each web of the first and second web rolls includes a backing or a separate, interleaved web. The transition assembly has a first mounting for allowing the first web roll to unwind and feed the first web to the feed path. A second mounting adjacent the first mounting allows the second web roll to unwind so that the second web may be spliced to the first web. A "bump splicing" unit causes an adhesive section of the second web to contact an end portion of the first web, as the first web roll runs out. Thus, a continuous web feed is accomplished by splicing the first and second webs "on the fly"; the new, incoming roll is caused to match the speed of the expiring roll within one revolution.

17 Claims, 6 Drawing Sheets

WEB FEEDING AND TRANSITION ASSEMBLY

FIELD OF THE INVENTION

The present invention pertains to a web-roll changing assembly, wherein a new, successive web roll is exchanged for an old, used web roll, as the web is being conveyed in a continuous manner by a web-conveying system, with each new web being spliced to the old web as the old web feed roll becomes spent; and, more particularly, to a web transition assembly for webs that have backing which is stripped therefrom, as each web is unwound, with the backing being stored simultaneously on a separate mandrel as each web is fed to the web conveyor.

BACKGROUND OF THE INVENTION

Web feeding and changing assemblies are well known in the art, as typically illustrated by U.S. Pat. No. 3,944,151 (issued to LEE et al on Mar. 16, 1976); U.S. Pat. No. 5,354,006 (issued to RÖDER on Oct. 11, 1994); U.S. Pat. No. 5,253,819 (issued to BUTLER, Jr., on Oct. 19, 1993); and U.S. Pat. No. 5,356,496 (issued to LINCOLN et al on Oct. 18, 1994).

These conventional web-transition assemblies typically exchange a new web of material for a used web, while the old web material is still being conveyed. In this way, the webs are changed "on the fly". A common mechanism for accomplishing this web transition is known in the art as a "bump splicer". The new, unused web comprises an adhesive surface that attaches to the old web through their "bumping" together, as they are simultaneously being conveyed. Thereafter, the web material trailing from the preceding, "old" web is severed at the splice; thus is the transition in the continuous, web-conveying process accomplished.

Exchanging an old web for a new web is a fairly common procedure. However, this procedure represents a long-standing problem, particularly when the web materials comprise backing, thus necessitating the handling of two layers on each web roll. Additional backing material from each web poses a particularly vexatious problem in accomplishing the transition from one web roll to another. Not only does each backing have to be unwound and stored as each web is advanced, but they must also somehow be positioned out of the splicing, or, "bump" zone, so that they do not interfere with the splice mechanism. Despite the profusion of mechanisms and assemblies for changing web materials on the fly, no one to date has been able to accomplish this transition for webs comprising a backing. Never accomplished until this invention, these two-layer splicing requirements present a daunting task for engineers and designers.

It is an object of the present invention to splice together two webs having backing, on the fly.

It is another object of the current invention to splice together webs having backing, on the fly, in a simple, reliable, low-cost manner.

SUMMARY OF THE INVENTION

In accordance with the present invention, there is provided a web feeding and transition assembly for exchanging a first, used web roll for a second, fresh web roll, so that web material will be continuously conveyed along a web-conveying feed path. Each web of the first and second web rolls comprises a backing. The transition assembly comprises a first mounting for allowing the first web roll to unwind and feed the first web to the feed path. A second mounting adjacent the first mounting allows the second web roll to unwind so that the second web may be spliced to the first web. A "bump splicing" unit causes an adhesive section of the second web to contact an end portion of the first web, as the first web roll is running out. Thus, a continuous web feed is accomplished by splicing the first and second webs "on the fly". The bump splicing unit also comprises a cutter to sever the trailing edge of the first web after the splice has been achieved. The transition assembly comprises a first backing storage mandrel immediately adjacent the first mounting for storing a first backing material that unwinds from the first web roll onto the first mounting. The transition assembly also comprises a second backing storage mandrel immediately adjacent the second mounting for storing a second backing material that unwinds from the second web roll, as it unwinds upon the second mounting.

The inventive transition assembly achieves this smooth exchange of first and second web rolls by displacing the first web roll and the first storage mandrel from a first position to a second position during the web transition. The second web roll and the second backing storage mandrel are then allowed to occupy that position vacated by the first web roll and the first backing storage mandrel, respectively. The transition assembly can further comprise a rotating turret, in which first and second web roll mountings and first and second backing storage mandrels are rotationally mounted together thereupon. As the turret rotates, the first and second web roll mountings and the first and second backing storage mandrels can be simultaneously interchanged with their counterparts, thus ensuring a smooth transition, with continuous web feed. An accumulator disposed in the feed path takes up any slack that may develop in the web during the splicing operation.

BRIEF DESCRIPTION OF THE DRAWINGS

A complete understanding of the present invention may be obtained by reference to the accompanying drawings, when considered in conjunction with the subsequent detailed description, in which:

FIG. 1 illustrates the frontal view of the web feeding and transition assembly, depicting a first, web-feeding roll, shown mounted on a rotatable turret, in a normal feeding position, with its backing being unwound and stored upon a storage mandrel, and a second, replacement, web-feeding roll mounted upon the turret opposite the first web-feeding roll, and waiting to be indexed by the turret;

FIG. 2 depicts the frontal view of the web feeding and transition assembly, with the web of the first roll expiring, and the backing material of the second, replacement roll shown wound upon a storage mandrel;

FIG. 3 shows the frontal view of the web feeding and transition assembly, with the turret rotated through ninety degrees;

FIG. 4 illustrates the frontal view of the web feeding and transition assembly, with the turret rotated through 180 degrees, and the second, replacement, web-feeding roll in a position to be spliced;

FIG. 5 depicts the frontal view of the web feeding and transition assembly, with the web of the second, replacement roll being spliced to the web of the first, web-feeding roll; and FIG. 6 shows the frontal view of the web feeding and transition assembly, with the trailing web of the first feeding roll having been severed from the spliced web of the second, replacement roll, and the web of the second roll having fully replaced the web of the first roll in the web-conveying apparatus.

For purposes of brevity and clarity, like elements and components will bear the same numerical designations throughout the FIGURES.

DESCRIPTION OF THE PREFERRED EMBODIMENT

Generally speaking, the invention features a web feeding and transition assembly for exchanging a first, used, web roll for a second, fresh, web roll, so that web material will be continuously fed and conveyed along a web-conveying feed path. Each of the first and second webs comprises a backing or a separate, interleaved web. The backing of each web roll is stored on a mandrel adjacent its respective web roll, as each web roll unwinds. The first and second web rolls, and their respective backing storage mandrels, are mounted upon a rotatable turret that interchanges the web positions as it rotates. A "bump splicer" forces an adhesive portion of the second, fresh, web roll to contact the web of the first, spent roll, as the first web continues to feed. A metallic foil disposed adjacent the adhesive portion moves past a sensor and activates the "bump splicer", thus bringing the two webs together. After a timed delay, a knife blade fires, thus severing the trailing edge of the first web. The second, fresh, web is now continuously fed to the web conveyor.

Figure 1:
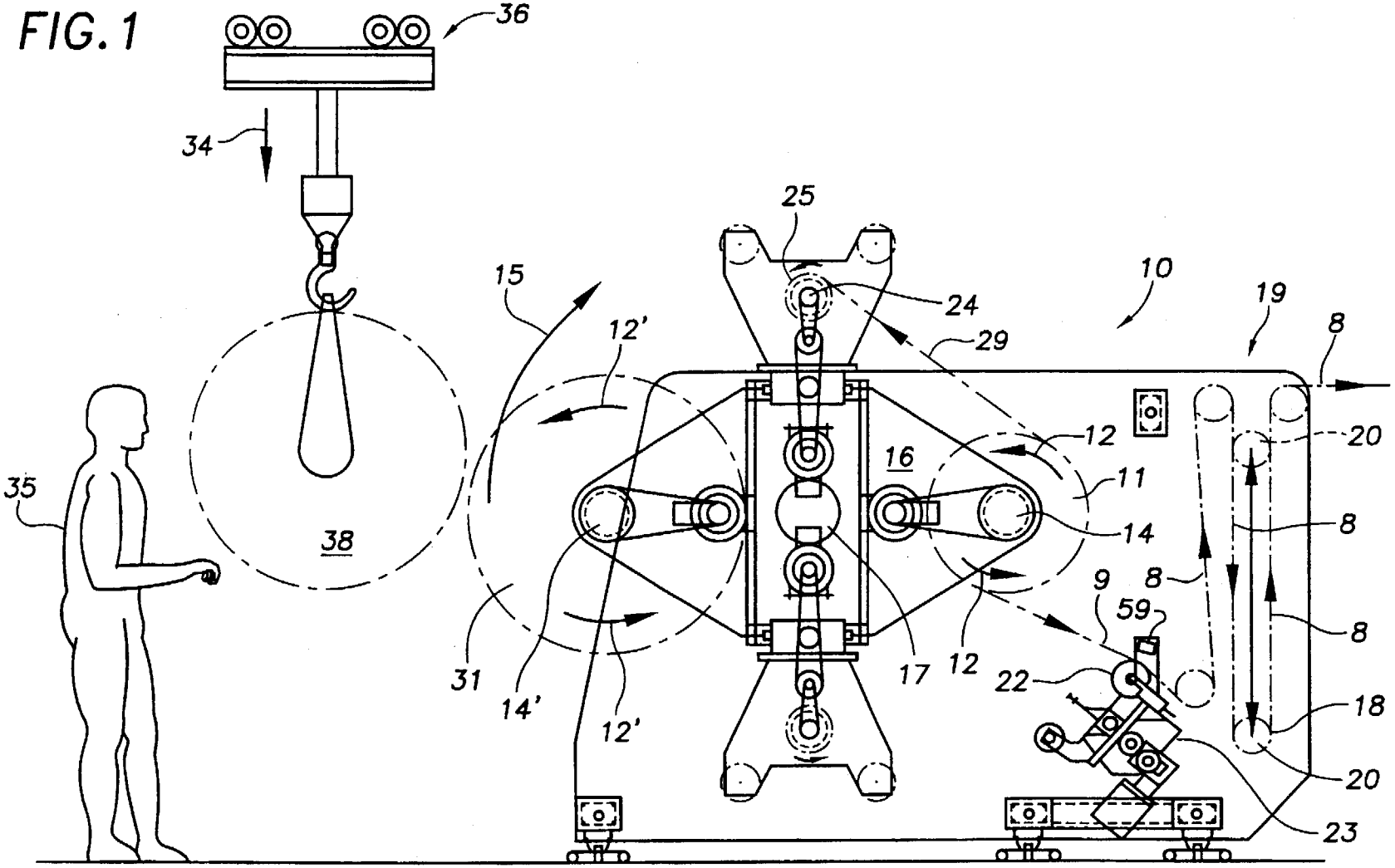
FIGS. 1 through 6, described in more detail herein, depict frontal, schematic, sequential views of a web feeding and transition assembly of this invention, wherein a web is fed to a web-conveying apparatus.
Figure 2:
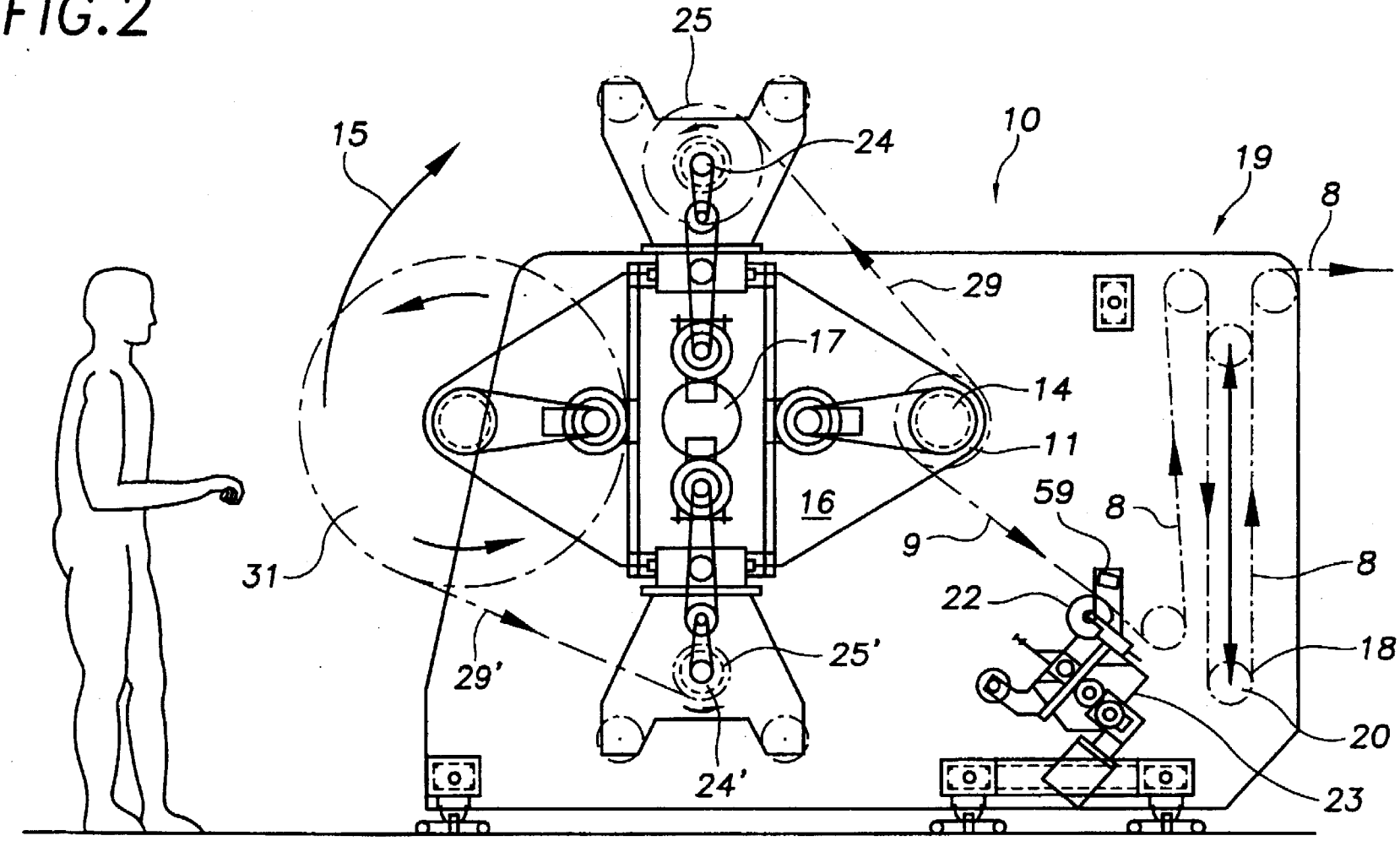

Now referring to FIGS. 1 through 6, a web transition and feeding assembly 10 of this invention is illustrated. A first web of material 9, having a backing 29, is initially wound upon a roll 11 that is rotationally mounted (arrows 12) upon a mandrel 14. The mandrel 14 is disposed upon a turret 16 that is itself rotatable (arrow 15) about a center shaft 17, as depicted in FIG. 1. The first web 9 is conveyed through a web-conveying system 19 comprising a web-tension, accumulator assembly 18, which adjusts for slack in the conveyor line. The accumulator 18 comprises a movable (arrows 21) conveyor roll 20 that is useful during the splicing of a new web onto the first web 9, as will be explained hereinafter. During the splicing procedure, it is not uncommon for a change of tension to occur in the web. The accumulator 18 assists in adjusting the tension to ensure that there is a continuous flow of web material through the conveying system 19.

Initially, web 9 is fed around a movable roller 22 that is disposed on a bump splicing unit 23; it then proceeds along a feed path 8 (defined by the arrows illustrated along web 9), as it is fed through conveyor system 19. As the web roll 11 unwinds (arrow 12), the backing material 29 is peeled from web 9 and wound upon a storage mandrel 24 to form a storage roll 25. Electric motors (not shown) respectively power the rotation of the mandrels 14 and 24 and the shafts 17 supporting the web rolls 11, the backing rolls 29 and the turret 16. On the left-hand side of the turret 16 is a duplicate mandrel 14' that rotationally supports (arrows 12') a second, replacement, web roll 31; its backing 29' (FIG. 2) is stored upon mandrel 24' as storage roll 25'.

Figure 3:
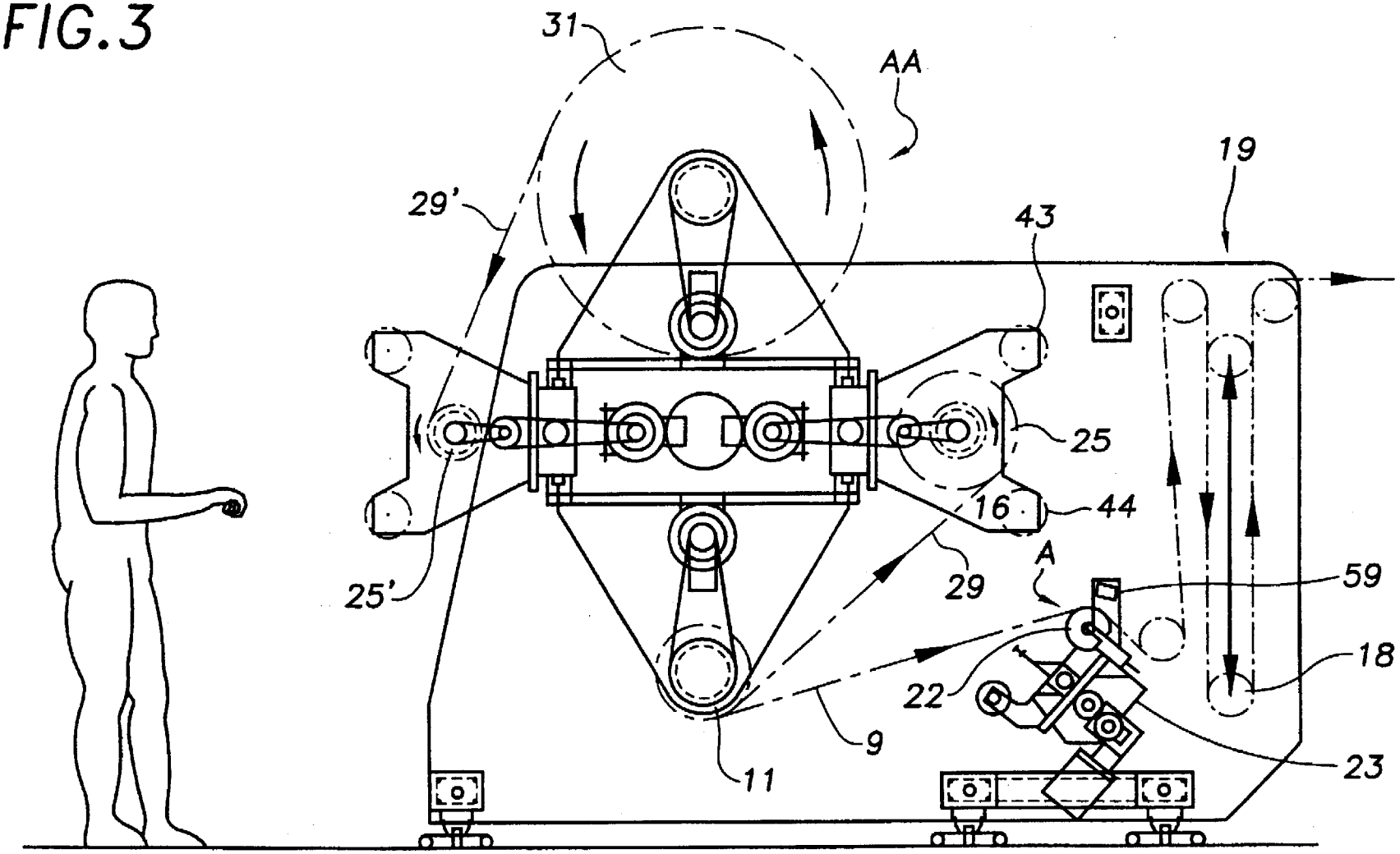
Figure 4:
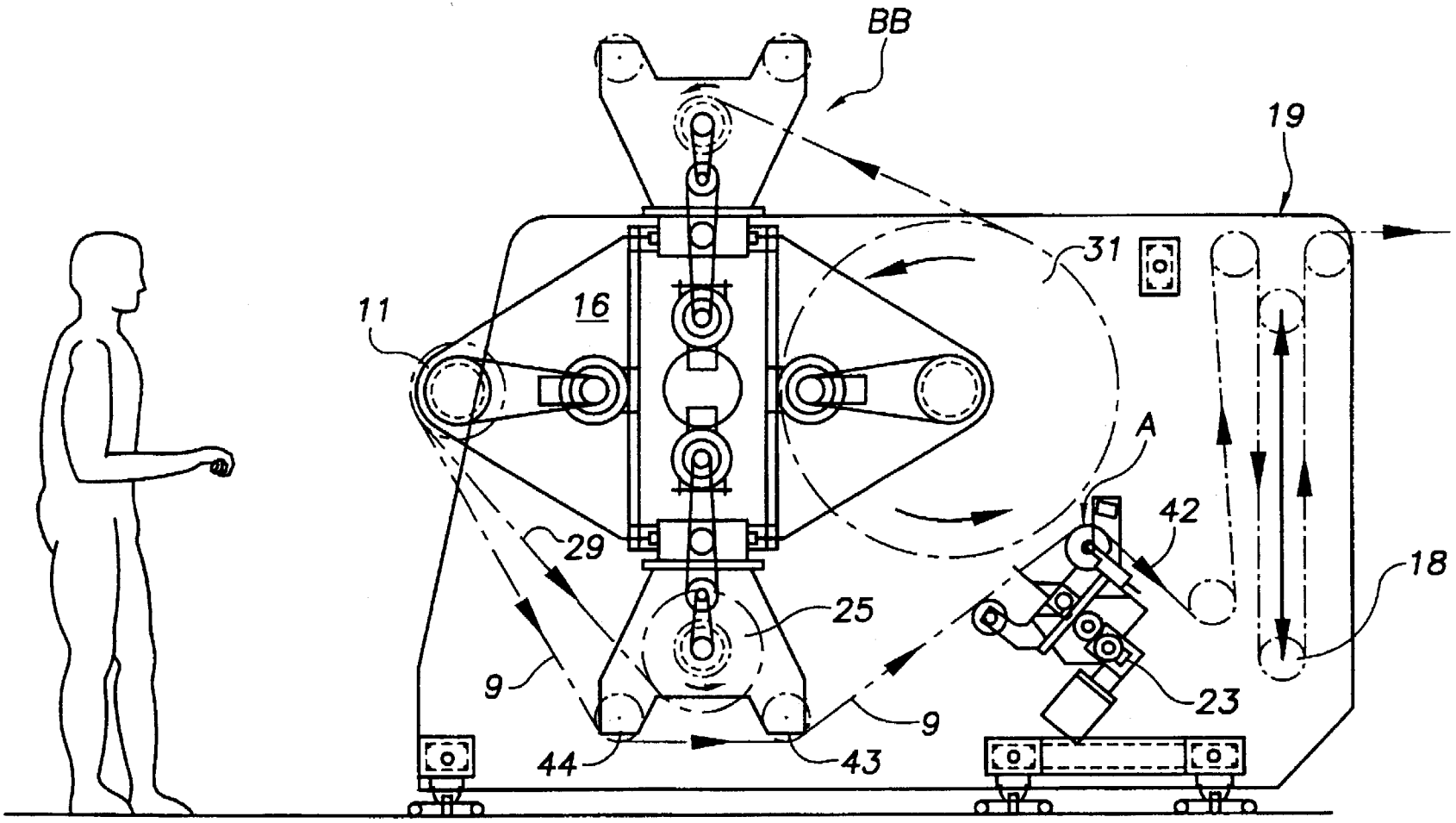

During the unwinding of the first web roll 11, the web 9 of the second, fresh roll 31 stands waiting to be spliced into the original web 9. As the web 9 runs out from the first web roll 11, the turret 16 starts rotating clockwise (arrow 15) to an intermediate, ninety-degree position "AA", as illustrated in FIG. 3, and then to the full 180° position "BB", as depicted in FIG. 4. During the turret rotation, the movable roller 22 on the bump splicing unit 23 is in a withdrawn position "A". The first web roll 11 then occupies the original position of the second web roll 31 (FIG. 4), and vice versa. The web 9 of the first roll is now supported over intermediate spanning rollers 43 and 44. Web 9 continues to be carried to the conveying system 19, as shown by arrows 42.

Figure 5:
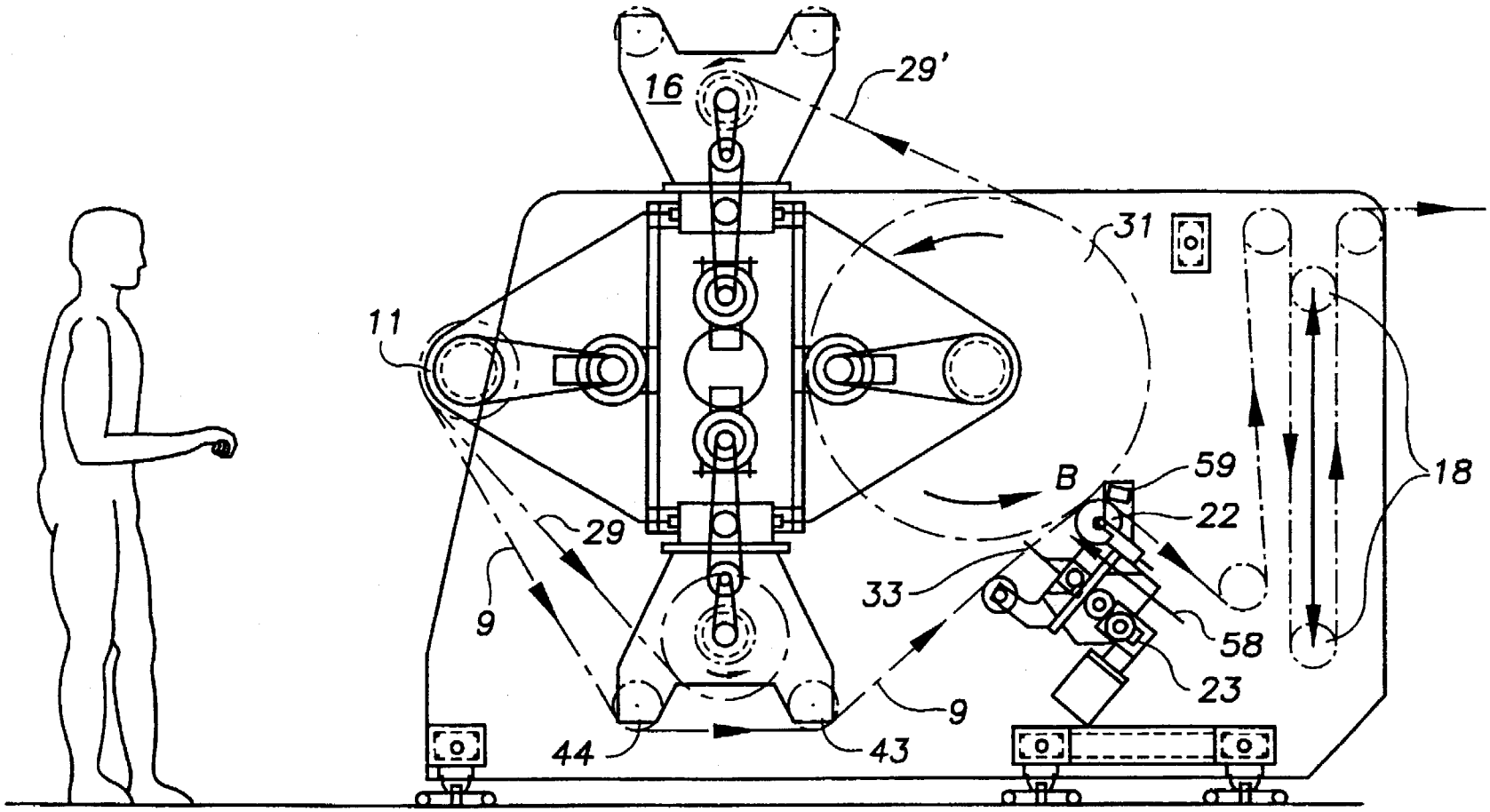

When the first web roll 11 is near depletion, as illustrated in FIG. 5, the bump splicing unit 23 is actuated, thus forcing movable roller 22 against the old web 9. The leading edge of the new web 9 will be forced into contact with the old web 9. The leading edge of the new web 9 contains an adhesive portion (not shown) that, when contacting the other web, forms a splice of the first, old web 9 with the second, new web 9. Adjacent the adhesive portion of the second web 9 is a metallic strip (not shown) that passes in front of a sensor 59, causing the bump splicing unit 23 to actuate. That is, the roller 22 is caused to move forward (arrow 58) to position "B". This metallic strip causes the sensor 59 to generate a signal that activates the movement of the roller 22, bringing it up to speed, within one revolution. After a half-second delay, a knife blade 33 is actuated; it cuts the trailing edge of the original, old, first web 9. The new web 9 now continues through the conveying system 19, as illustrated in FIG. 6.

Figure 6:
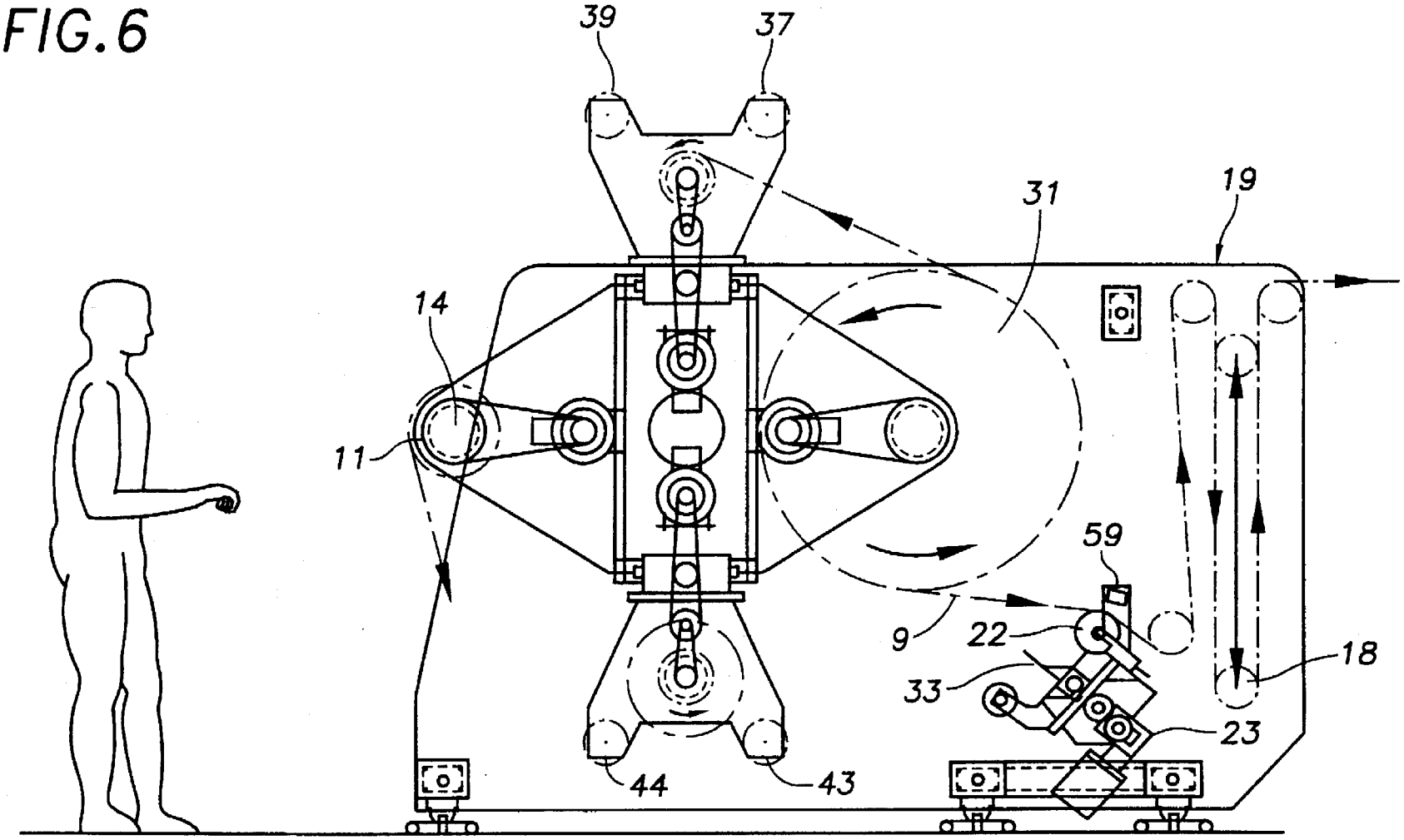

An operator 35 using an overhead crane 36 (FIG. 1) now lowers (arrow 34) a new web roll 38 into position, for placement upon the mandrel 14, to fill the vacated space yielded by the used web roll 11 (FIG. 6). The new web 9 from web roll 31 is supported by intermediate rollers 37 and 39 which are disposed on an opposite end of turret 16, when the turret 16 is again rotated (arrow 15) to splice the new web roll 38.

The bump splicing unit 23, the knife blade 33 and the motors for powering the rotation of the various mandrels and shafts are well-known components in this art. Therefore, for a practitioner of this art to obtain a full understanding of the invention, the description need not provide greater detail. The adhesive portion, the metallic strip and the sensor are, likewise, elements that have been used before to effectuate the splice and cutting of web materials and, therefore, do not require further explanation for those skilled in this web-feeding art.

For the sake of definition, the backing materials 29 and 29', respectively, can be used to separate interleaved second webs (say 9*a* and 9*b*, not shown), respectively. Roll 11 can house dual webs 9 and 9*a*, and roll 31 can house dual webs 9*c* and 9*b*, respectively; they can be fed to a dual conveying system 19 (not shown).

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A web feeding and transition assembly for exchanging a first, spent, web roll for a second, fresh, web roll, so that web material will be continuously fed and conveyed along a web-conveying feed path, comprising:

a web-conveying feed path;

a first web roll containing at least a first web having a first backing material disposed adjacent said web-conveying feed path;

a second web roll containing at least a second web having a second backing material;

means for respectively, rotationally mounting said first web roll and said second web roll in juxtaposition thereto, wherein said first and second web rolls are capable of unwinding, so as to be fed along said web-conveying feed path;

storage means disposed adjacent said first and second web rolls for storing said first and second backing materials, respectively;

splicing means disposed adjacent said first web roll for splicing said second web to said first web on-the-fly, while said first web is continuing to unwind, and when said first web roll becomes substantially spent; and transition means for supporting said first web roll for movement from a first, direct, web-feeding position to a second, displaced, web-feeding position, whereby said second web can be placed adjacent said splicing means, and wherein said second web can be spliced to said first web to effect a continuous feeding of web material along said web-conveying feed path.

2. The web feeding and transition assembly in accordance with claim 1, wherein said transition means comprises means for moving said second web roll into said first, direct, web-feeding position.

3. The web feeding and transition assembly in accordance with claim 1, wherein said transition means comprises a rotating turret for rotationally supporting said first and second web rolls, respectively, said transition means interchanging said first web roll disposed at said first, direct, feeding position with said second web roll disposed at said second, displaced, web-feeding position.

4. The web feeding and transition assembly in accordance with claim 3, wherein said rotating turret further comprises intermediate supports for supporting web material during transitional movement of the first and second web rolls.

5. The web feeding and transition assembly in accordance with claim 1, further comprising an accumulator disposed along said web-conveying feed path for adjusting tension in said web as it moves therethrough.

6. The web feeding and transition assembly in accordance with claim 1, wherein said splicing means further includes a bump splicer and cutting means.

7. A web feeding and transition assembly for exchanging a first, spent, web roll for a second, fresh, web roll, so that web material will be continuously fed and conveyed along a web-conveying feed path, comprising:

a web-conveying feed path;

a first web roll containing at least a first web having a first backing material disposed adjacent said web-conveying feed path;

a second web roll containing at least a second web having a second backing material, and an adhesive portion disposed upon a front section of said second web for effectuating a splice with said first web;

means for respectively, rotationally mounting said first web roll and said second web roll in juxtaposition thereto, wherein said first and second web rolls are capable of unwinding, so as to be fed along said web-conveying feed path;

storage means disposed adjacent said first and second web rolls for storing said first and second backing materials, respectively;

splicing means disposed adjacent said first web roll for splicing said second web to said first web by bringing into contact said adhesive portion of said second web with a trailing portion of said first web; and transition means for supporting said first web roll for movement from a first, direct, web-feeding position to a second, displaced, web-feeding position, whereby said second web can be placed adjacent said splicing means, and wherein said second web can be spliced to said first web on-the-fly, while said first web is continuing to unwind, and to effect a continuous feeding of web material along said web-conveying feed path.

8. The web feeding and transition assembly in accordance with claim 7, wherein said transition means comprises means for moving said second web roll into said first, direct, web-feeding position.

9. The web feeding and transition assembly in accordance with claim 7, wherein said transition means comprises a rotating turret for rotationally supporting said first and second web rolls, respectively, said transition means interchanging said first web roll disposed at said first, direct, feeding position with said second web roll disposed at said second, displaced, web-feeding position.

10. The web feeding and transition assembly in accordance with claim 9, wherein said rotating turret further comprises intermediate supports for supporting web material during transitional movement of the first and second web rolls.

11. The web feeding and transition assembly in accordance with claim 7, further comprising an accumulator disposed along said web-conveying feed path for adjusting tension in said web as it moves therethrough.

12. The web feeding and transition assembly in accordance with claim 7, wherein said splicing means further includes a bump splicer and cutting means.

13. A web feeding and transition assembly for exchanging a first, spent, web roll for a second, fresh, web roll, so that web material will be continuously fed and conveyed along a web-conveying feed path, comprising:

a web-conveying feed path;

a first web roll containing at least a first web having a first backing material disposed adjacent said web-conveying feed path;

a second web roll containing at least a second web having a second backing material;

means for respectively, rotationally mounting said first web roll and said second web roll in juxtaposition thereto, wherein said first and second web rolls are capable of unwinding, so as to be fed along said web-conveying feed path;

storage means disposed adjacent said first and second web rolls for storing said first and second backing materials, respectively;

splicing means disposed adjacent said first web roll for splicing said second web to said first web on-the-fly, while said first web is continuing to unwind; and a turret for supporting said first and second web rolls for transitional, interchangeable movement between a first, direct, web-feeding position and a second, displaced, web-feeding position, whereby said second web can be placed adjacent said splicing means, and wherein said second web can be spliced to said first web to effect a continuous feeding of web material along said web-conveying feed path.

14. The web feeding and transition assembly in accordance with claim 13, wherein said turret is rotatably mounted for rotationally supporting said first and second web rolls, respectively, wherein interchange can occur between said first web roll disposed at said first, direct, feeding position with said second web roll disposed at said second, displaced, web-feeding position.

15. The web feeding and transition assembly in accordance with claim 14, wherein said rotating turret further comprises intermediate supports for supporting web material during transitional movement of the first and second web rolls.

16. The web feeding and transition assembly in accordance with claim 13, further comprising an accumulator disposed along said web-conveying feed path for adjusting tension in said web as it moves therethrough.

17. The web feeding and transition assembly in accordance with claim 13, wherein said splicing means further includes a bump splicer and cutting means.

* * * * *